US007479096B2

(12) United States Patent
Saikawa

(10) Patent No.: US 7,479,096 B2
(45) Date of Patent: Jan. 20, 2009

(54) MUSCLE TRAINING MACHINE FOR THE WHOLE BODY

(76) Inventor: Makoto Saikawa, 1033-223 Kire-Nakamyo-cho, Kagoshima-shi, Kagoshima (JP) 891-0202

( * ) Notice: Subject to any disclaimer, the term of this patent is extended or adjusted under 35 U.S.C. 154(b) by 354 days.

(21) Appl. No.: 11/032,543

(22) Filed: Jan. 10, 2005

(65) Prior Publication Data

US 2005/0164849 A1 Jul. 28, 2005

(30) Foreign Application Priority Data

Jan. 9, 2004 (JP) ..... 2004-034240

(51) Int. Cl.
*A63B 21/00* (2006.01)

(52) U.S. Cl. ..... 482/100; 482/142; 482/133

(58) Field of Classification Search ..... 482/135, 482/101, 138, 104–108, 137, 126, 98–99
See application file for complete search history.

(56) References Cited

U.S. PATENT DOCUMENTS 4,720,099 A * 1/1988 Carlson ..... 482/133
4,730,839 A * 3/1988 Miyoshi ..... 180/415
4,746,116 A 5/1988 Inada
6,120,419 A 9/2000 Huang
6,244,999 B1 * 6/2001 Alessandri ..... 482/142
6,602,170 B2 8/2003 Ilic
6,905,446 B2 * 6/2005 Greenland ..... 482/100

* cited by examiner

*Primary Examiner*—Jerome Donnelly
(74) *Attorney, Agent, or Firm*—Fox Rothschild LLP

(57) ABSTRACT

A machine for training the muscles of a user's body, comprising a main body; a right-use and a left-use arm member extending from the main body at least higher than the user's hips; a right and a left rotational member, which are each established on the respective right-use and left-use arm members so that they freely rotate about and extend away from rotational central axes that extend toward the user; and a right and a left handle, which are each established on the respective right and left rotational members so that they freely rotate about handle central axes extending in a parallel direction to the respective rotational central axes; wherein the user can hold the handles with the user's respective right and left hands, and turn the rotational members, independently of each other, about the rotational central axes, for training the upper body of the user.

9 Claims, 5 Drawing Sheets

MUSCLE TRAINING MACHINE FOR THE WHOLE BODY

CROSS-REFERENCE TO RELATED APPLICATIONS

This application claims the benefit of Japanese Patent Application No. 2004-34240 by the present inventor entitled "Muscle Training Machine For the Whole Body", filed on Jan. 9, 2004, the disclosure of which is hereby incorporated by reference.

FIELD OF THE INVENTION

The present invention relates generally to the design of a muscle training apparatus and more particularly, to the design of a training machine for the muscles of the whole body.

BACKGROUND OF THE INVENTION

Human beings consist of several hundred muscles and bones, to enable complex joint operations. Conventional training or exercise machines have significant limitations in terms of the number of muscles that one machine can exercise. Indeed, they are very much limited in the muscles that they can strengthen.

For example, one machine may assign loads to and train the muscles for pushing forward the arm. Another, separate machine may apply a load to the muscles for pulling back the arm.

The various independent machines each require various independent movements. Thus, when one goes to a typical fitness gym, one may need to use at least ten types of machines and perform ten types of movements, in order to train the muscles of the whole body.

As examples of known exercise machines, U.S. Pat. No. 6,120,419 discloses a multifunctional exercise machine that is simply constructed and foldable, to be suitable for use in a private home. U.S. Pat. No. 6,602,170 discloses a full body exerciser which consists of a torso exercising apparatus for performing various calisthenics and maneuvers to tone and build the body. U.S. Pat. No. 4,746,116 discloses a universal physical exercising device comprising a U-shaped vertical frame structure and a pedal member, for facilitating full kinematic exercises.

However, none of these conventional machines can provide the simultaneous imposition of loads on every possible work scope of the joints below the neck, in the human body. Neither can they offer the application of all such loads with only one machine having a simple design, using only one series of movements.

Therefore, an apparatus that allows the simultaneous application of loads in all operational directions of the joints of the whole body (below the neck), using one machine, is highly desired. It is also desired to obtain a training apparatus for training all of the muscles simultaneously, with one series of movements.

SUMMARY OF THE INVENTION

The above discussed and other problems and deficiencies of the prior art are overcome by the apparatuses of the present invention. According to one aspect of the present invention, there is provided a machine for training the muscles of a user's body having a main body; a right-use and a left-use arm member extending from the main body at least higher than the user's hips; a right and a left rotational member, which are each established on the respective right-use and left-use arm members so that they freely rotate about and extend away from rotational central axes that extend toward the user; and a right and a left handle, which are each established on the respective right and left rotational members so that they freely rotate about handle central axes extending in a parallel direction to the respective rotational central axes; wherein the user can hold the handles with the user's respective right and left hands, and turn the rotational members, independently of each other, about the rotational central axes, for training the upper body of the user. In the machine, the rotational members are disks, and with a surface of each disk facing the user, the disks are established at their center points upon the respective right-use and left-use arm members to rotate freely, wherein the handles are each established at a periphery of the surfaces of the disks. In addition, each of the handle comprises: a handle body which is established on a respective the rotational member so that it freely rotates about a handle central axis extending in a parallel direction to the rotational central axis; and a holding part established on the handle body to freely rotate about an axis extending orthogonally to the handle central axis, which the user can hold with the right and left hands. An arrangement of the right-use arm member and left-user arm member rotate about a vertical axis, and a unit including the rotational members and the handles revolve within at least a fixed angle. The central rotational axis of the right rotational member and the central rotational axis of the left rotational member form an angle of between 105 and 130 degrees.

In accordance with another aspect of the invention, the main body has a base comprising a base member for establishment on a floor surface; and a user support member atop the base member, arranged so that it rotates freely about a vertical axis extending towards the user, where the user can place his right and left feet at each end of the user support member to allow the rotation of his hips about the vertical axis. The above-mentioned machine further comprise a rotating plate arranged to lie between the user's foot and a top surface of an end of the user support member, so that it rotates freely about a vertical axis. The above-mentioned machine further comprises a gripping part established atop the rotating plate, for gripping the user's foot to prevent a sliding of the foot. The gripping part has a plurality of column members formed of an elastic material, the plurality of column members being arranged to deform and fit with a shape of the foot. The base member has a regulating member for controlling a rotational angle of the user support member.

The above discussed and other features and advantages of the present invention will be appreciated and understood by those skilled in the art from the following detailed description and drawings.

DETAILED DESCRIPTION OF THE INVENTION

Figure 1:
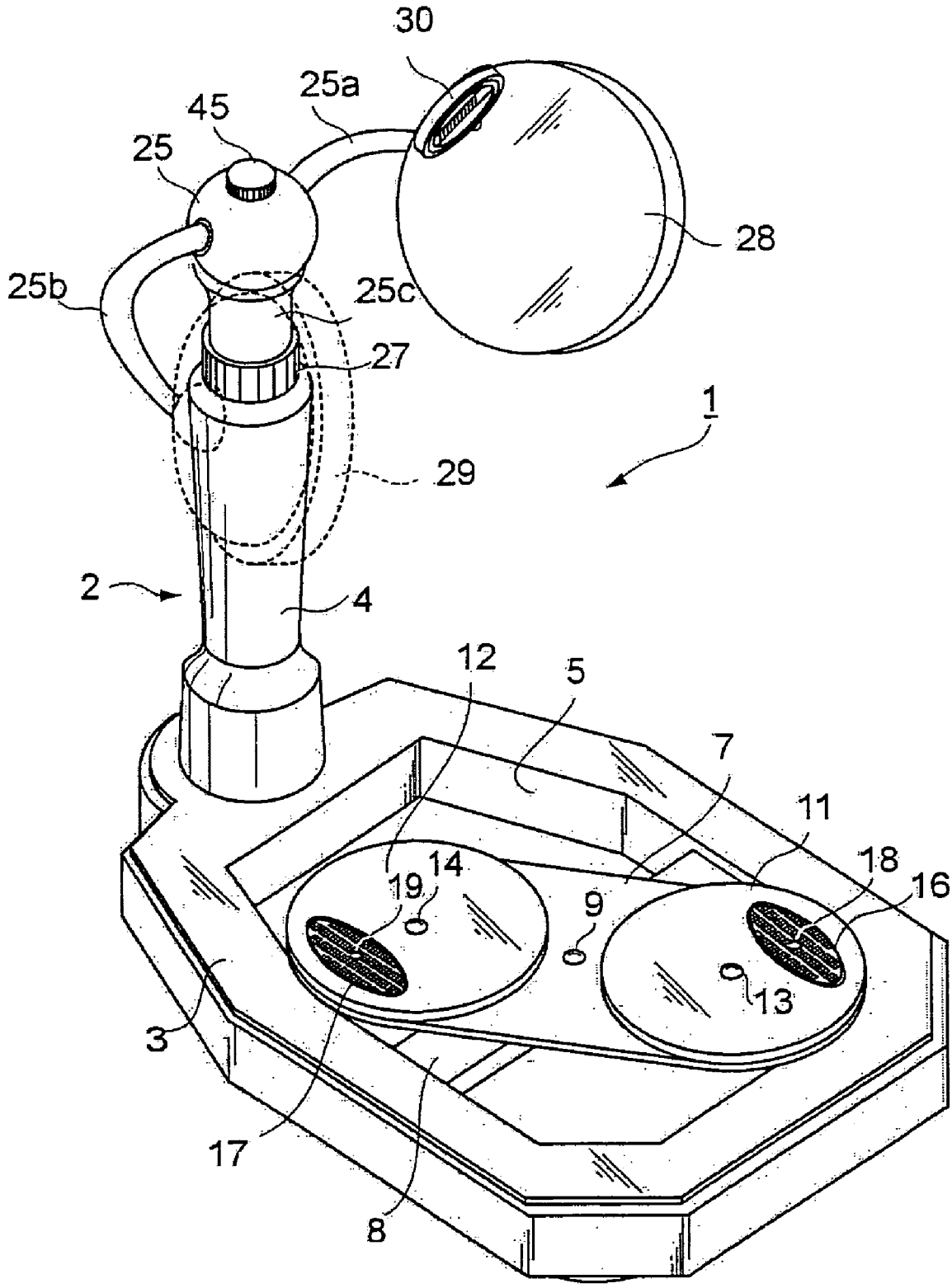
FIG. 1 shows a perspective view of a training machine embodying the principles of the present invention.

Referring generally to FIG. 1, a training machine 1 in accordance with the present invention comprises a main body 2 having a bottom base 3 extending horizontally. An elongated part 4 extends vertically from one end of this floor base 3.

This bottom base 3 has a hole 5 provided therein for achieving lighter weight. Within this hole 5, for the purposes of holding a leg board 7, is built a bridge part 8. The leg board 7 is an elliptically-shaped rigid board member. It is installed to freely rotate on the bridge part 8 by inserting a pin or bolt 9 at its center point. With this arrangement, the leg board 7 can rotate about a vertical axis while maintaining its top surface in a horizontal position.

Figures 8A, 8B, 8C:
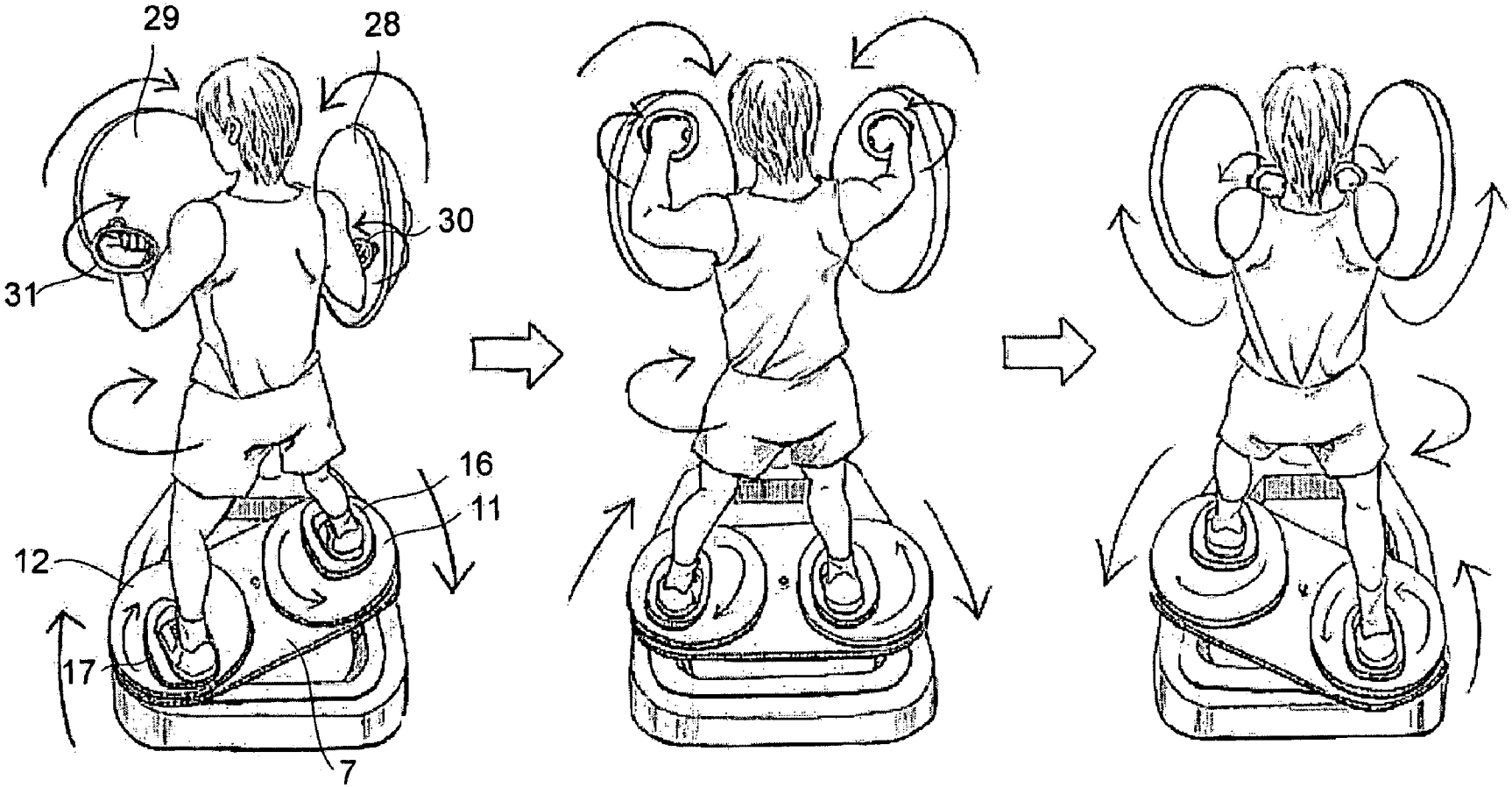
FIGS. 8A-C show rear views of succeeding poses within an exemplary exercise movement enabled by the present invention.

A pair of disk-shaped leg plates 11 and 12 for use by the right leg and left leg, respectively, are arranged on the top surface of the leg board 7. One leg plate is arranged at each end of the leg board 7, to match the interval between the user's legs (as shown in FIGS. 8A-C). Each leg plate 11 or 12 is installed on the leg board 7 with a pin or bolt 13 and 14 through a center point area, or other means commonly known in the art. They are arranged horizontally on the top surface of the leg board 7, to rotate freely about vertical axes.

Proximate to the peripheral areas of the top surfaces of leg plates 11 and 12 are respectively arranged oval-shaped foot plates 16 and 17. Again, these foot plates 16 and 17 are installed on the respective leg plates 11 and 12 using pins or bolts 18 and 19 or other means commonly known in the art. This construction again allows free rotations of those foot plates 16 and 17.

Figure 3:
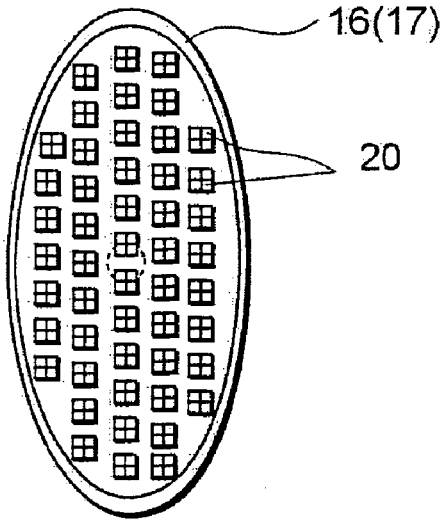
FIG. 3 shoes an enlarged top view of the foot plate embodied in the present invention.
Figure 4:
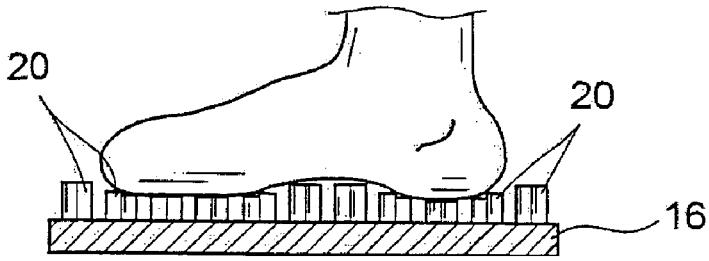
FIG. 4 shows a side view of the foot plate illustrated in FIG. 3, with a foot placed thereon.

FIG. 3 shows an enlarged top view of the foot plate 16 (17). FIG. 4 illustrates a side view of the foot plate 16 (17), having a foot placed thereon. As shown in FIG. 3, a plurality of elastic-type projections 20 are provided on the top surface of the leg plate 16 (17). The projections 20 bear cross-shaped cuts and are constructed to be easily deformable. As detailed in FIG. 4, these projections 20 are arranged to be of a size and number to deform according to the irregularities on the sole of a user's foot.

With this assembly, as shown in FIGS. 8A-C, the user can place his feet on the respective foot plates 16 and 17. Then, he can accomplish various movements such as the twisting of the ankles and legs, the bending of the knees, and the turning of the hips.

Figure 5:
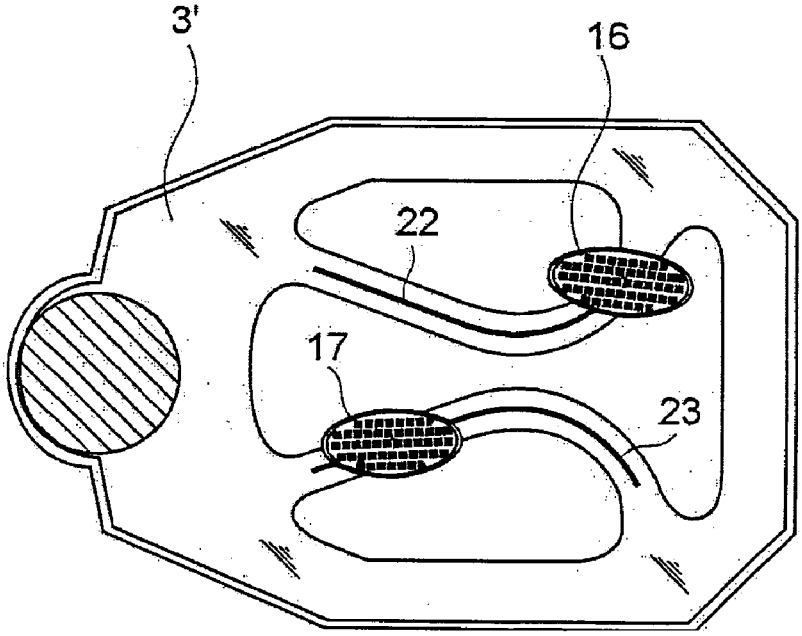
FIG. 5 shows a top view of an alternative embodiment of the bottom base portion embodied in the present invention.

FIG. 5 illustrates another embodiment of the bottom base 3. A pair of symmetrically positioned rails 22 and 23 are arranged on the bottom base 3. The above-mentioned foot plates 16 and 17 are arranged on top of the respective rails 22 and 23. These leg plates 16 and 17 are installed on the rails 22 and 23 to be horizontally freely movable along the length of the rails 22 and 23, as well as horizontally freely rotatable, by a coupling means not shown in the illustration. This construction provides an effectiveness similar to the previously described embodiment.

Figure 2:
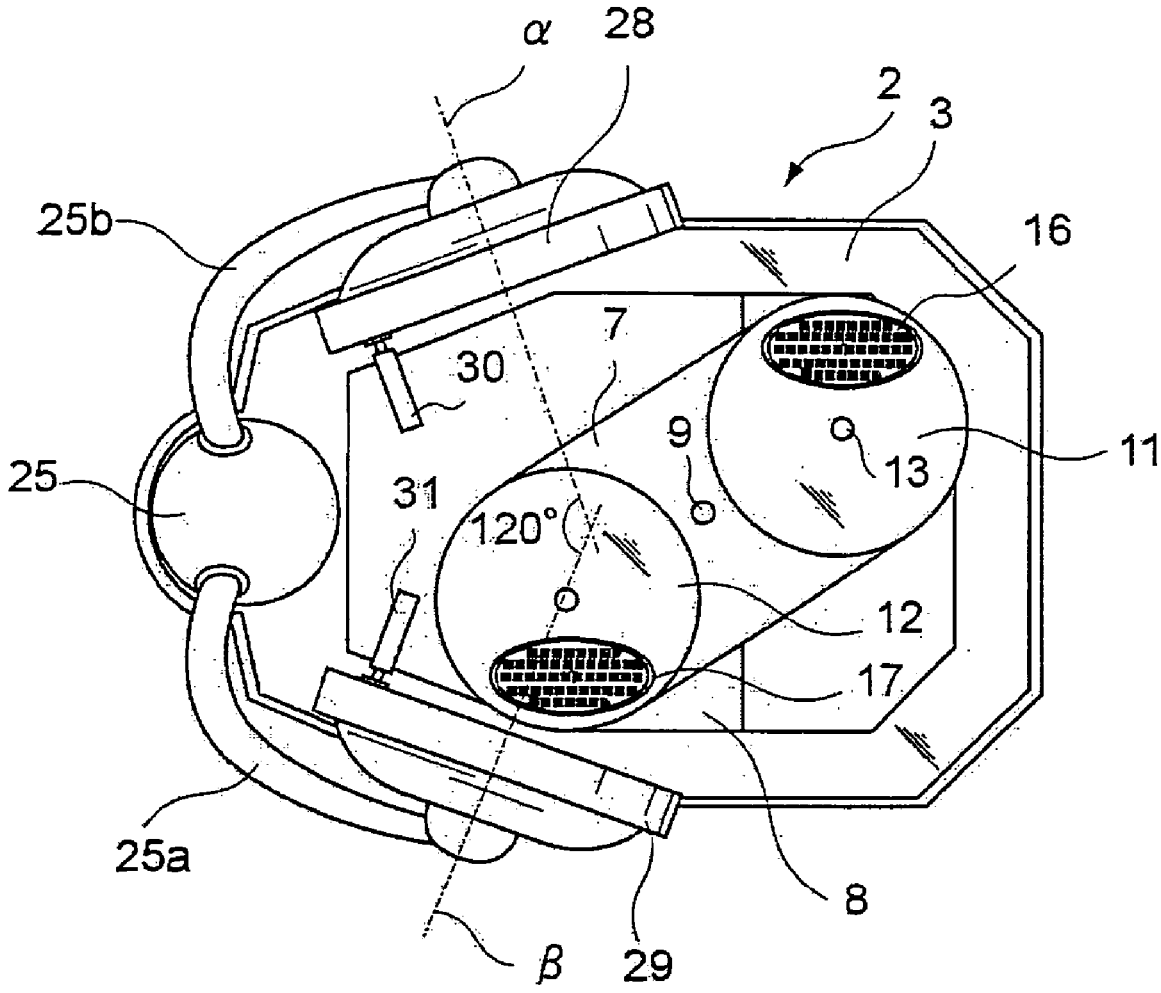
FIG. 2 shows a top view of the training machine of FIG. 1.

We now continue with an explanation of the portion of the machine corresponding to the user's upper body. As shown in FIGS. 1 and 2, at the top end of the elongated part 4 of the main body 2 is positioned an arm member 25. This member 25 has left and right arms 25*a* and 25*b*, corresponding to the respective left and right arms of the user. A downwardly extending bottom portion 25*c* of the arm member 25 has its end further inserted within a top end opening of the elongated part 4 of the main body 2.

A screw-type fixing ring 27 fixes the height of the arm member 25. In other words, the height of the arm member 25 can be adjusted along an axis line of the above-mentioned elongated part 4. Furthermore, this fixing ring 27 allows the revolving of the arm member 25 (relative to the main body 2) within fixed left-right angles. Thus, the direction of the arms 25*a* and 25*b* can correspond with the direction of the user's body, without changing the relative angle between the arms 25*a* and 25*b*.

Right and left disks 28 and 29 are installed at each end point of the arms 25*a* and 25*b*, so that they rotate freely. They are positioned so that their respective rotational axes $\alpha$ and $\beta$ (shown in FIG. 2) extend toward the user. In the present embodiment, the rotational axes $\alpha$ and $\beta$ of the right-left disks 28 and 29 are established at an angle of 120° C.

However, by turning a handle 45 provided on the arm member 25 connected to the arms 25*a* and 25*b*, one can adjust the angle formed by these rotational axes $\alpha$ and $\beta$, within a range of 105° C. and 130° C.

Figure 6:
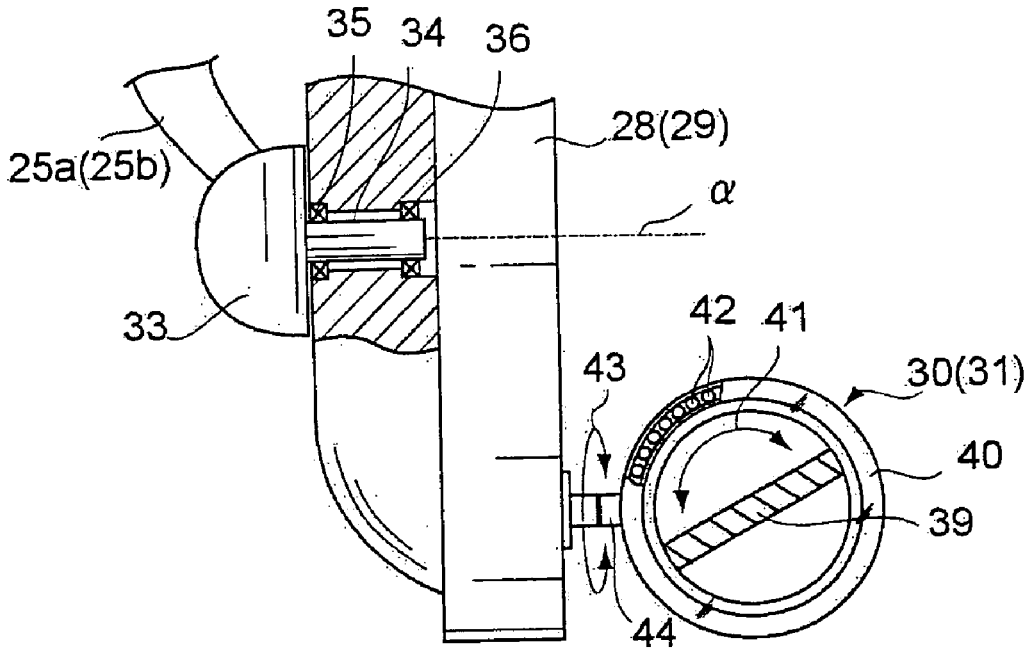
FIG. 6 shows a side, partially sectional view of a portion of the rotational disk and corresponding handle unit.

Respective right and left handles 30 and 31 are fixed at peripheral regions of the surfaces of the rotational disks 28 and 29. FIG. 6 illustrates an enlarged side, partially sectional view of the rotational disk 28 (29) and the corresponding handle unit 30 (31).

In the present embodiment, a dome-shaped retention part 32 is fixed to the back side of the rotating disk 28. A shaft 34 extending from the end point 33 of the arm 25*a* (25*b*) is inserted within this retention part 32. This shaft 34 is arranged to engage, as an example, with bearings 35 and 36 and freely rotate. In this way, the rotating disk 28 (29) can rotate about the its rotational axis $\alpha$ ($\beta$) with small amounts of resistance.

Additionally, the handle unit 30 (31) has two movable mechanisms. Firstly, a handle holding part 39 which the user grasps is provided on the handle 30 (31), where a ring-shaped rotational mechanism 40 can rotate this holding part 39 in the direction shown by the arrow 41. This rotation occurs about an axis which is orthogonal to the rotational axis $\alpha$. As shown in the partial sectional view, this first rotational mechanism 40 has a plurality of ball bearings 42, contained within its circumferential area. These ball bearings 42 allow for smooth rotations.

A second rotational mechanism 44 is provided on an outer surface of the first rotational mechanism 40, for freely rotating the part that includes the first rotational mechanism 40 and the holding part 39. This rotation occurs in the direction indicated by the arrow 43, about an axis parallel to the above-mentioned rotational axis $\alpha$. The second rotational mechanism 44 has an end point of a rotating section fixed to the outside surface of the first rotational mechanism 40. The other end point, of a non-rotating section, is fixed to the surface of the above-mentioned rotational disk 28.

As shown in FIGS. 8A-C, the rotation of the disk 28 results in the changing of the user's wrist posture. With the above-described construction, the handle unit 30 allows the direction of the holding part 39 to vary freely in accordance with these changes in wrist posture.

Thus, the present arrangement of the rotational disks and handles permit various movements such as the rotation of the arms, the turning of the arms, and the twisting of the wrists. Furthermore, as shown in FIG. 2, the disks 28 and 29 are arranged so that their rotational axes intersect at an angle of 120° C., permitting the variation of the horizontal distance between the handles 30 and 31. This assembly allows for opening and closing movements of the arms.

Figure 7:
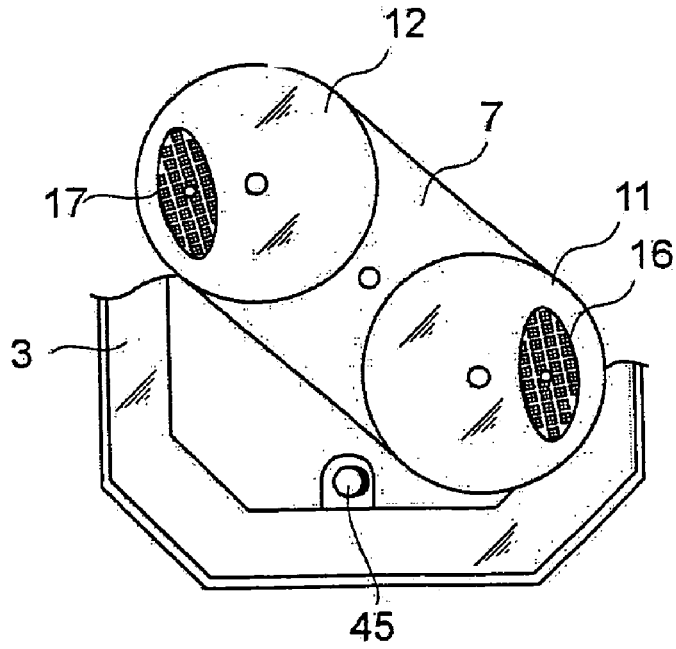
FIG. 7 shows a top view of yet another alternative embodiment of the bottom base portion.

In yet another mode of the present invention, a removable stopper 45 may be disposed on the bottom base 3, as shown in FIG. 7. The stopper 45 enables the stopping of the rotation of the leg board 7 at an intermediate point, during its rotational movements. This arrangement results in easier regulation of the leg movements, which may be especially helpful for beginning users of the machine.

The above-described embodiments enable many various exercises. The specific combination, layering and positional angles of the rotatable members allow for the systematic exercising of the wrists, arms, trunk (backbone), hips (lower back), legs and ankles, including their twisting capabilities, as well as the imposition of loads on every work scope of the joints below the neck in the human body.

The following describes one example of such an exercise:

In the initial state for beginning the exercise, as shown in FIG. 8A, the user grasps the right and left handles 30 and 31 with his respective hands and pulls on the respective disks 28 and 29 to position the handles close to the user's forefront, with the user holding the handles 30 and 31 in a reverse position (palms facing upward).

Then, the arm member 25 is turned somewhat towards the user's left side and set up in a leftwardly diagonal position. Both feet are placed on the foot plates 16 and 17 and set up such that, as shown in FIG. 8A, the legs are opened in a front-back position, with the right leg in the front. This configuration is this exercise's first posture.

From this state, the left foot on foot plate 17 is brought to the front, while rotating the leg plate 12 and leg board 7, and simultaneously the right foot is brought towards the back (the user can revolve the feet in either outward or inward circles). Grasping handles 30 and 31 with the hands, both arms are moved from a leftwardly slanted position at the user's forefront, to upwards directions, where the arm disks 28 and 29 are revolved forwards. At that time, the hands are twisted from the reverse position to the customary position (the handles 30 and 31 are spun 180° C. and the backs of the hands face upwards), as illustrated in FIG. 8B.

Following the same orbit of motion (inertia), the arm disks 28 and 29 are then pulled back in a downwards direction to a rightwardly slanted, forefront position (at that time, the handles 30 and 31 are revolved 180° C. so that the palms face upwards again), as shown in FIG. 8C.

Then, the legs, reversing the previous position, move such that the right leg goes to the front and the left leg goes to the back, through rotating leg plates 11 and 12 and leg board 7. Meanwhile, both arms push out the arm disks 28 and 29 from the rightwardly diagonal direction to the frontwards direction (at that time, the hands are again twisted from the reverse to the customary palm down positions), and along with that orbit of motion (inertia), the user returns to the leftwardly slanted, handles at the forefront position.

This exemplary exercise repeats the above-described movement. This one series of actions produces loads in every direction of the joints below the neck, of the human body (equaling loads on every muscle required to move in all such directions). In other words, this one series of movements can train the muscles of the entire body.

For further explain, the bodies of human beings have several hundred muscles. Contraction exercises of those muscles move the joints. In other words, the hands, feet and torso are moved through such contractions.

Furthermore, each movement of the body consists of the aggregation of the movements of the individual joints. In concrete terms, the contractions/extensions of the skeletal muscles connected to the bones causes the movements of the joints, and the resultant motions.

Muscles for achieving bending, or "flexors", and muscles for achieving straightening, or "extensors", are at each joint. The movement of the joints are accomplished through the contraction of the flexors when bending and the contraction of the extensors when straightening. Accordingly, if one can apply loads in every direction of movement of such joints, one can exercise every muscle for moving those joints, in all of those directions.

Regarding the arms, the present machine can apply loads for front-back, open-close (left-right), up-down, and twisting movements, as well as for every possible operation of the arm joints. The above described exercise movement will apply loads for the arms moving down→up, up→down, open→close, close→open, back→front, front→back, turning inwards, and turning outwards.

For example, "pushing out" loads get applied when pushing the arm disks 28 and 29 from the forefront in the forwards direction. Simultaneously, since the front areas of the arm disks 28 and 29 are positioned closer together than the back, "closing" loads also get conveyed on both arms. Alternatively, when pulling back to the forefront, "pulling" and "opening" loads are conveyed on both arms. The same applies for moving the plates 28 and 29 in the upwards and downwards directions, as well.

The turning of the handles 30 and 31 enables the imposition of loads for twisting movements of the arms, thereby exercising those twisting muscles that the arm disks 28 and 29 cannot strengthen. The machine even enables the application of loads onto the wrists. Furthermore, one single movement enables the strengthening of every muscle for all possible arm movements.

Regarding the legs, placing the feet on the foot plates 16 and 17 and horizontally revolving leg plates 11 and 12 and leg board 7 produces front-back, open-close (left-right) movements, and the application of loads in those directions. Spinning the leg exercising members results in the imposition of twisting loads, as well. Alternatively, trying to keep such movements in check also produces twisting loads for the legs.

Thus, this machine applies loads in all operational directions of the leg joints. Unlike exercise bicycles, these movements are horizontal, rather than vertical. However, training the muscles for moving the legs front-back also covers the training of all muscles necessary for the legs' up-down movements.

Rotating the leg board 7 also enables the twisting of the waist, causing the application of loads for the waist. In other words, the machine enables the strengthening of the muscles for turning the waist.

Regarding the torso, revolving at the arm member 25 conveys a load for the twisting of the upper body, thereby training the muscles for such upper body twists. In the above-described exercise, the user stands firmly with both legs apart, spins the arm disks 28 and 29 and pushes outwardly and frontwardly from his forefront. Then, the users pulls back from the frontward direction back to the forefront area relative to his body. This exercise conveys loads on the front-back movements of the torso and trains the muscles used for such trunk movements.

This movement also conveys loads for leg movements used in pushing objects. (Spinning the leg plates 11 and 12 alone may not be sufficient to train the joints of the ankles. Thus, this movement also strengthens the necessary muscles for such joints, such as the calf muscles.) Alternatively, loads also get applied to leg movements in pulling or pulling-stretching, such as those used in tug-of-war, thereby training the leg muscles used in pulling objects.

Additionally, as described above the user can use both arms to revolve arm disks 28 and 29 and push out upwardly, from the rightwardly diagonal, forefront direction. Following that orbit of inertia, the arm disks 28 and 29 can then be pulled back downwardly towards a leftwardly diagonal direction. Then, both arms can revolve and push outward from the leftwardly diagonal direction. Using that orbit of inertia, the arms can get returned back to the rightwardly diagonal direction.

This movement spins the arm member 25 in left-right directions, while applying loads on the wrenching of the torso and the front-back motion of the upper body. Thus, it enables the simultaneous exercising of the muscles for moving the trunk sideways and in left-right directions.

Therefore, the above-described one series of movements conveys loads on every work direction of every main joint below the neck, of the whole human body, using only one machine. That is, one series of movements can simultaneously train every muscle of the whole body.

It should be noted that indoor bicycles or running machines cannot achieve the strengthening of the leg muscles in all directions. They also lack effectiveness in translating strength from the legs (while standing firmly with legs wide apart) up to the body and the hands. The present machine thus achieves an overall, superior strengthening of the leg muscles that conventional leg training machines cannot provide.

Finally, the training of the entire body at once means a high amount of energy consumption. Thus, the present invention also allows the simultaneous training of the heart-lung functions, as well.

The foregoing description of the embodiments of this invention has been presented for purposes of illustration and description. It is not intended to be exhaustive or to limit the embodiments of the invention to the form disclosed, and obviously, many modifications and variations are possible.

As an example, one or more of the various components may be made immovable and/or non-rotatable, such as the leg board 7, to variously broaden or limit the applied loads on the muscles of the whole body. However, it should be noted that even omitting the 360° C. rotational ability of the handles 30 and 31 and the rotational ability of the arm member 25 (relative to the main body), will still allow the machine to achieve the strengthening of the major muscles of the whole body.

Alternatively, one or more of the various components may be made adjustable in other ways. Furthermore, stoppers similar to that shown in FIG. 7 for controlling the leg board 7 may also be applied to limit the rotational movements of the other exercise members, as well. Such modifications and variations that may be apparent to a person skilled in the art are intended to be included within the scope of this invention as defined by the accompanying claims.

What is claimed is:

1. A machine for training the muscles of a user's body, comprising:

a main body;

a right-use and a left-use arm member extending from the main body at least higher than the user's hips;

a right and a left rotational member, which are each established on the respective right-use and left-use arm members so that they freely rotate about and extend away from rotational central axes that extend toward the user; and a right and a left handle, which are each established on the respective right and left rotational members so that they freely rotate about handle central axes extending in a parallel direction to said respective rotational central axes;

wherein said user can hold said handles with the user's respective right and left hands, and turn said rotational members, independently of each other, about said rotational central axes, for training the upper body of the user wherein said main body has a base comprising:

a base member for establishment on a floor surface; and a user support member atop said base member, arranged so that it rotates freely about a vertical axis extending towards said user, where the user can place his right and left feet at each end of said user support member to allow the rotation of his hips about said vertical axis.

2. The machine of claim 1, wherein said rotational members are disks, and with a surface of each disk facing the user, said disks are established at their center points upon the respective right-use and left-use arm members to rotate freely, wherein said handles are each established at a periphery of said surfaces of said disks.

3. The machine of claim 1, wherein each said handle comprises:

a handle body which is established on a respective said rotational member so that it freely rotates about a handle central axis extending in a parallel direction to said rotational central axis; and a holding part established on said handle body to freely rotate about an axis extending orthogonally to said handle central axis, which said user can hold with said right and left hands.

4. The machine of claim 1, wherein an arrangement of said right-use arm member and left-user arm member rotate about a vertical axis, and a unit including said rotational members and said handles revolve within at least a fixed angle.

5. The machine of claim 1, wherein said central rotational axis of said right rotational member and said central rotational axis of said left rotational member form an angle of between 105 and 130 degrees.

6. The machine of claim 1, further comprising a rotating plate arranged to lie between said user's foot and a top surface of an end of said user support member, so that it rotates freely about a vertical axis.

7. The machine of claim 6, further comprising a gripping part established atop said rotating plate, for gripping said user's foot to prevent a sliding of the foot.

8. The machine of claim 7, wherein said gripping part has a plurality of column members formed of an elastic material, said plurality of column members being arranged to deform and fit with a shape of said foot.

9. The machine of claim 1, wherein said base member has a regulating member for controlling a rotational angle of said user support member.

* * * * *